US006447972B1

(12) United States Patent
Nakajima et al.

(10) Patent No.: US 6,447,972 B1
(45) Date of Patent: Sep. 10, 2002

(54) CHARGING MEMBER FOR DEVELOPMENT OF ELECTROSTATIC LATENT IMAGE, ELECTROSTATIC LATENT IMAGE DEVELOPER, AND MAGNETIC SLEEVE

(75) Inventors: Tomohito Nakajima; Sakon Takahashi; Kozo Ota; Chiaki Suzuki, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/717,065

(22) Filed: Nov. 22, 2000

(30) Foreign Application Priority Data

May 22, 2000 (JP) ..... 2000-150097

(51) Int. Cl.[7] ..... G03G 9/113
(52) U.S. Cl. ..... 430/111.35
(58) Field of Search ..... 430/108.11, 111.35; 399/168

(56) References Cited

U.S. PATENT DOCUMENTS 6,124,067 A * 9/2000 Mikuriya et al. ..... 430/111.3

FOREIGN PATENT DOCUMENTS

| | | |
|---|---|---|
| JP | 59-104664 | 6/1984 |
| JP | 60-66264 | 4/1985 |
| JP | 61-80161 | 4/1986 |
| JP | 61-80162 | 4/1986 |
| JP | 61-80163 | 4/1986 |
| JP | 5-249749 | 9/1993 |
| JP | 7-114219 | 5/1995 |
| JP | 10-213924 | 8/1998 |
| JP | 2000-66455 | 3/2000 |

* cited by examiner

*Primary Examiner*—Mark Chapman
(74) *Attorney, Agent, or Firm*—Oliff & Berridge, PLC

(57) ABSTRACT

A charge-providing member or carrier for the development of an electrostatic latent image comprising a resin coat layer provided on a core material, characterized in that the coating resin comprises a (meth)acrylic acid alkyl ester copolymer containing as copolymerizing components a (meth) acrylic acid alkyl ester containing a branched alkyl group having 4 or more carbon atoms and a (meth) acrylic acid alkyl ester containing a fluorine-containing alkyl group, a developer comprising such a carrier, and a sleeve for carrying such a developer.

17 Claims, No Drawings

CHARGING MEMBER FOR DEVELOPMENT OF ELECTROSTATIC LATENT IMAGE, ELECTROSTATIC LATENT IMAGE DEVELOPER, AND MAGNETIC SLEEVE

BACKGROUND OF THE INVENTION

The present invention relates to a charge-providing member for use in electrophotography, electrostatic recording method, electrostatic printing method, etc. More particularly, the present invention relates to a one-component developing sleeve or carrier for the development of an electrostatic latent image, an electrostatic latent image developer comprising such a carrier for the development of an electrostatic latent image, and a magnetic sleeve for carrying such an electrostatic latent image developer.

Processes for rendering image data visible via electrostatic image such as electrophotographic process find wide application in various fields. An electrophotographic process normally comprises forming an electrostatic latent image on a photoreceptor or electrostatic recording material by various means, and then allowing a particulate electroscopic material called toner to be attached to the electrostatic latent image to develop and render the electrostatic image visible. Developers for this purpose can be roughly divided into two groups, i.e., two-component developer comprising a supporting particulate material called carrier and a particulate toner which are triboelectrically charged mutually to provide the toner with a proper amount of positive or negative charge and one-component developer comprising a single particulate toner such as magnetic toner which is triboelectrically charged mutually with a development sleeve. In particular, the two-component developer comprises a carrier which itself is capable of stirring, conveying and electrifying. Thus, the functions required for the developer can be separately considered. Accordingly, this type of a developer can be easily designed and thus finds wide application.

Carriers for this purpose can be roughly divided into two groups, i.e., coated carrier having a coat layer provided on the surface thereof and uncoated carrier free of coat layer. The coated carrier is superior to the uncoated carrier taking into account charging properties and life of developer. Thus, various coated carriers have been developed and put in practical use. The coated carrier has various requirements. In particular, the coated carrier is required to invariably provide the toner with a proper chargeability (amount and distribution of charge), exhibit stable charging properties even with environmental change and maintain these proper and stable charging properties over an extended period of time. In order to meet these requirements, it is important that the carrier has proper electrical properties, a sufficient resistance to change in environmental factors such as humidity and temperature and high impact resistance and friction resistance and maintain desired charge-providing properties over an extended period of time. To this end, various coated carriers have been proposed.

The two-component developer can be electrified when the toner and the carrier are triboelectrically charged with each other. However, triboelectrical charging is liable to change of charge level under some environmental conditions. In general, the two-component developer can be easily charged to a high level under low temperature and low humidity conditions but can be easily charged to a low level under high temperature and high humidity conditions. Accordingly, the two-component developer is disadvantageous in that environmental change is accompanied by the reduction of density upon high level electrification or occurrence of fog upon low level electrification.

Referring to the charging properties of resin for coating carrier, the change in electrification accompanying environmental change (hereinafter referred to as "environmental change") increases as the electrification capacity becomes higher. For example, a carrier comprising a polymethacrylic acid methyl as a coating resin can be charged to a higher level than a carrier comprising a polystyrene but shows a greater environmental change than the other. In other words, a resin material having a high polarity can be charged to a high level but shows a great environmental change. On the contrary, a resin material having a low polarity shows a small environmental change but can be charged to a low level. It is thus difficult for coated carrier to provide a developer which can be charged to a desired level and shows a small environmental change.

The carrier is also required to maintain a desired charge level over an extended period of time (maintenance of chargeability). The deterioration of the carrier is mainly attributed to fixing of toner components to the surface of carrier coating resin or peeling of the coating resin. In order to prevent these troubles, it has been practiced to use a fluororesin or silicone resin so that the surface energy of the coating resin can be lowered to prevent staining or select a resin which is strong enough to resist peeling. However, a resin material having a low surface energy exhibits a poor adhesivity to particulate nucleus material. It has thus been keenly desired to accomplish low stainability and high peeling resistance at the same time.

As solution to some of these problems, JP-A-61-80161 (The term "JP-A" as used herein means an "unexamined published Japanese patent application"), JP-A-61-80162 and JP-A-61-80163 propose that by coating the surface of a carrier core material with a copolymer of nitrogen-containing alkyl (meth)acrylate fluoride and vinyl monomer or a copolymer of alkyl (meth)acrylate fluoride and nitrogen-containing vinyl monomer, a coated carrier can be obtained which can be difficultly stained with a toner and external additives and thus has a relatively long life.

However, a fluororesin has poor charging properties. When a fluororesin is copolymerized with a nitrogen-containing vinyl monomer or methylmethacrylic acid ester monomer having a high polarity to enhance its chargeability, it is newly disadvantageous in that it shows an increased environmental change.

JP-A-59-104664 focuses on methacrylic acid ester monomer and proposes a carrier coated with a polymer of methacrylic acid cycloalkyl ester aimed at moisture resistance.

However, this carrier is disadvantageous in that it can be charged to a lower level than methyl methacrylate. This carrier is also disadvantageous in that the coating resin is brittle and has a poor adhesivity to particulate nucleus material.

In order to eliminate these disadvantages, JP-A-7-114219 proposes a copolymer of methacrylic acid cycloalkyl ester and methyl methacrylate.

However, even when the copolymerizing ratio of the two components is adjusted in various ways, it is difficult to accomplish the desired charge level and environmental stability at the same time. Thus, it has been difficult to accomplish reliability requirements for carrier, i.e., charge level, maintenance of chargeability and environmental stability at the same time.

SUMMARY OF THE INVENTION

Therefore, the present invention is intended to solve the foregoing problems and provide a charge-providing member for the development of an electrostatic latent image, carrier for the development of an electrostatic latent image and electrostatic latent image developer which can fairly charge a toner to a proper and stable level, have a resistance to environmental change high enough to maintain a stable charging level and can maintain these charging properties over an extended period of time, and a sleeve for carrying such a developer.

The inventors made extensive studies of elimination of the foregoing problems of the prior art. The inventors studied a hundred and scores of coating resins. As a result, resins for charge-providing member or carrier are found which exhibit excellent charging properties under humid conditions, less charge enhancement under low humid conditions and excellent charge maintenance. Further, the study of the control over the structure of coat layer and the core material resulted in the provision of a carrier optimum for charge level and charge maintenance. Moreover, the application of a toner having a high sphericity to the foregoing charge-providing member or carrier resulted in the provision of a developer which gives a high image quality and exhibits an excellent transferability. Further, the external addition of spherically particulate silica having a high sphericity to a toner resulted in the provision of a developer having an excellent transferability. Moreover, the adjustment of the surface conditions of a sleeve for carrying a developer resulted in the provision of a high image quality free from carrier scattering. In other words, the employment of the following constitutions made it successful to solve the foregoing problems.

(1) A charge-providing member for the development of an electrostatic latent image comprising a resin coat layer provided on a core material, wherein
the coating resin comprises a (meth) acrylic acid alkyl ester copolymer containing as copolymerizing components a (meth)acrylic acid alkyl ester containing a branched alkyl group having 4 or more carbon atoms and a (meth) acrylic acid alkyl ester containing a fluorine-containing alkyl group.

(2) The charge-providing member for the development of an electrostatic latent image according to the foregoing constitution (1), wherein
the coating resin exhibits a contact angle of from 80 to 150 degrees with respect to water.

(3) The charge-providing member for the development of an electrostatic latent image according to the foregoing constitution (1), wherein
the core material is a magnetic particulate material.

(4) The charge-providing member for the development of an electrostatic latent image according to the foregoing constitution (1), which is a one-component developing sleeve.

(5) The charge-providing member for the development of an electrostatic latent image according to the foregoing constitution (3), wherein
the coating resin exhibits a contact angle of from 80 to 150 degrees with respect to water.

(6) The charge-providing member for the development of an electrostatic latent image according to the foregoing constitution (3), wherein
the magnetic particulate material has an average particle diameter of from 20 $\mu$m to 100 $\mu$m.

(7) The charge-providing member for the development of an electrostatic latent image according to the foregoing constitution (3), wherein
as the copolymerizing component of the (meth)acrylic acid alkyl ester there is incorporated a $C_{1-5}$ straight-chain alkyl group.

(8) The charge-providing member for the development of an electrostatic latent image according to the foregoing constitution (3), wherein
the copolymer has a graft copolymer structure.

(9) The charge-providing member for the development of an electrostatic latent image according to the foregoing constitution (3), wherein
the coating resin has a weight-average molecular weight Mw of from 5,000 to 250,000.

(10) The charge-providing member for the development of an electrostatic latent image according to the foregoing constitution (3), wherein
the coating resin has one or more particulate resins dispersed therein.

(11) The charge-providing member for the development of an electrostatic latent image according to the foregoing constitution (3), wherein
the resin coat layer comprises a finely divided electrically-conductive material dispersed therein.

(12) The charge-providing member for the development of an electrostatic latent image according to the foregoing constitution (3), wherein
as a particulate nucleus body there is used a magnetic powder-dispersed spherical core material having a shape factor ($ML^2/A$) or 125 or less, a true specific gravity of from 3 to 4 g/cm$^3$ and a saturation magnetization of 50 emu/g or more.

(13) An electrostatic latent image developer comprising a toner and a carrier, wherein
the toner has a shape factor ($ML^2/A$) or 125 or less and as the carrier there is used a carrier for the development of an electrostatic latent image according to the foregoing constitution (3).

(14) The electrostatic latent image developer according to the foregoing constitution (13), wherein
the toner is prepared by a wet process.

(15) The electrostatic latent image developer according to the foregoing constitution (13), wherein
the toner has a spherically particulate silica having a cumulative volume-average particle diameter $D_{50V}$ of from 80 to 300 nm externally added to the surface thereof.

(16) A process for the formation of an image comprising the steps of
forming a latent image on a latent image holding member,
developing the latent image with a developer provided on a sleeve, and
transferring the developed toner image onto a transferring material, wherein
the sleeve to be used in the developing step has a surface having a fine roughness such that the ten point average roughness Rz on roughness curve is from 10 $\mu$m to 30 $\mu$m and the arithmetic mean roughness Ra on roughness curve is from 1 $\mu$m to 5 $\mu$m according to JIS B0660 and the developer to be used in the developing step is a developer according to the foregoing constitution (13).

(17) The process for the formation of an image according to the foregoing constitution (16), wherein
the toner has a spherically particulate silica having a cumulative volume-average particle diameter $D_{50V}$ of from 80 to 300 nm externally added to the surface thereof.

DETAILED DESCRIPTION OF THE PREFERRED EMBODIMENTS

The present invention lies in a charge-providing member or carrier for the development of an electrostatic latent image having a resin coat layer formed on a core material or particulate nucleus material. The foregoing coating resin comprises a (meth)acrylic acid alkyl ester copolymer containing as copolymerizing components a (meth) acrylic acid alkyl ester containing a branched alkyl group having 4 or more carbon atoms and a (meth) acrylic acid alkyl ester containing a fluorine-containing alkyl group. The use of the foregoing (meth)acrylic acid alkyl ester containing a branched alkyl group makes it possible to give a capability of providing a toner with a high chargeability and maintain a capability of providing a chargeability over an extended period of time even with environmental change.

When the number of carbon atoms in the foregoing branched alkyl group is 3 or less, the foregoing properties cannot be provided. The upper limit of the number of carbon atoms in the foregoing branched alkyl group is 20. When the number of carbon atoms in the foregoing branched alkyl group exceeds 20, the resulting polymer becomes remarkably brittle itself. Further, the resulting coat layer becomes too soft and has an adverse effect on the storage properties or fluidity of carrier and thus cannot be used as a coating material. Accordingly, when the number of carbon atoms in the foregoing branched alkyl group falls within the range of from 4 to 20, a coating material having proper performance can be provided.

Specific examples of the (meth) acrylic acid alkyl ester containing a branched alkyl group include those having an ester moiety carbon chain substituted by one or more alkyl groups such as methyl group such as tertiary butyl (meth) acrylate, isobutyl (meth)acrylate, sec-butyl (meth)acrylate, neo-pentyl (meth)acrylate and isopentyl (meth)acrylate.

Further, the use of the foregoing (meth)acrylic acid alkyl ester containing a fluorine-containing alkyl group makes it possible to lower the surface energy of the coating resin and hence prevent the toner from being attached to the charge-providing member or carrier. The foregoing fluorine-containing alkyl group is not specifically limited. As the fluorine-containing alkyl group there may be used any proper compound taking into account the balance of the surface stain resistance-providing capability of carrier and the softness of coat layer.

Specific examples of the foregoing (meth)acrylic acid alkyl ester containing a fluorine-containing alkyl group include trifluoroethyl (meth)acrylate, tetrafluoroethyl (meth) acrylate, perfluoropentyl (meth)acrylate, perfluoropentylethyl (meth)acrylate, perfluorooctyl (meth) acrylate, perfluorooctylethyl (meth)acrylatem and perfluorododecyl (meth)acrylate.

As the copolymerizing component of the (meth)acrylic acid alkyl ester copolymer constituting the coating resin of the invention there can be used a $C_{1-5}$ straight-chain alkyl group to effectively compensate for the brittleness of the polymer derived from the (meth) acrylic acid containing a branched alkyl group and improve the adhesivity to the particulate nucleus material. When the number of carbon atoms in the foregoing alkyl group is 6 or more, the resulting coat layer becomes too soft and has an adverse effect on the storage properties or fluidity of carrier and thus cannot be used as a coating material.

The copolymerizing ratio of the monomer component having a branched alkyl group in the (meth) acrylic acid alkyl ester copolymer constituting the coating resin of the invention falls within the range of from 5% to 95% by weight, preferably from 15% to 90% by weight. The copolymerizing ratio of the monomer component having a fluorine-containing alkyl group in the (meth)acrylic acid alkyl ester copolymer constituting the coating resin of the invention falls within the range of from 5% to 40% by weight, preferably from 5% to 30% by weight. When the copolymerizing ratio of the two monomer components falls below 5% by weight, the desired functions cannot be accomplished. Further, when the copolymerizing ratio of the monomer component having a fluorine-containing alkyl group exceeds 40% by weight, it is disadvantageous in the strength and chargeability of the resulting coat layer.

The mixing ratio of the monomer component containing a straight-chain alkyl group is from 0% to 70% by weight, preferably from 10% to 45% by weight. The mixing ratio of the monomer component containing a straight-chain alkyl group can be properly predetermined taking into account the chargeability and the balance of various properties of coating material.

The weight-average molecular weight of the foregoing copolymer falls within the range of preferably from 5,000 to 250,000, particularly from 10,000 to 200,000 from the standpoint of the strength of coat layer and the handleability of the resin.

The resin coat layer of the invention may comprise other resins in admixture besides the coating resin as necessary. Specific examples of these resins include styrene-based resin, acrylic resin, styrene-acryl copolymer resin, olefin-based resin, vinyl ketone-based resin, vinyl ether-based resin, vinylpyridine-based resin, epoxy resin, amide resin, polyester-based resin, and imide resin. The mixing ratio of such a resin falls within the range of from 0% to 50% by weight, preferably from 10% to 40% by weight.

The charge-providing member and carrier for the development of an electrostatic latent image of the invention may comprise the monomers defined with reference to the foregoing coating resin copolymerized with other monomers to further improve the foregoing functions. Examples of the copolymerizable monomers employable herein include vinyl-based fluorine-containing monomers such as vinylidene fluoride, tetrafluoroethylene, hexafluoropropylene, monochlorotrifluoroethylene, monochloroethylene and trifluoroethylene, nitrogen-containing acryls such as dimethylaminoethyl methacrylate, nitrites such as acrylonitrile and methacrylonitrile, vinyl pyridines such as 2-vinylpyridine and 4-vinylpyridine, vinylethers, and vinylketones. The amount of these copolymerizable monomers to be incorporated in the coating resin is preferably from 10 to 100 parts by weight, particularly from 30 to 100 parts by weight based on 100 parts by weight of the coating resin. When the amount of these copolymerizable monomers to be incorporated falls below 10 parts by weight, the resulting effect is reduced particularly on the improvement of resistance to environmental change.

The resin coat layer of the invention needs to have a contact angle of from 80 to 150 degrees with respect to water. When the contact angle falls below 80 degrees, the desired stain resistance of the surface of the coat layer cannot be secured. On the contrary, when the contact angle exceeds 150 degrees, the resulting resin coat layer exhibits an extremely deteriorated adhesivity to the particulate nucleus material. Thus, the coating resin is not suitable for coating. The preferred range of the contact angle of the resin coat layer of the invention is from 80 to 130 degrees.

For the measurement of the contact angle of the resin coat layer of the invention, a Type CA-DTA contact angle meter produced by KYOWA INTERFACE SCIENCE CO., LTD. is used. In some detail, a uniform layer of coating resin is formed on a flat plate by an arbitrary method. Subsequently, purified water is put in a syringe. A water droplet having a specified size is then formed on the tip of the needle. The resin-coated flat plate is then slowly brought close to the water droplet. When the resin-coated flat plate is brought into contact with the water droplet, the flat plate is then immediately brought downward. The angle of the tangent line of the water droplet at the end thereof with respect to the surface of the resin is then measured.

In accordance with the present invention, the resin coat layer comprises a particulate resin dispersed therein. In this arrangement, the resin coat layer is provided with a stabilized capability of providing charge and an enhanced mechanical strength. The uniform dispersion of a particulate resin in the resin coat layer makes it possible to maintain the same surface configuration as shown in the initial stage of use even if the surface of the coat layer is worn after prolonged use. Thus, a stabilized capability of providing charge can be maintained over an extended period of time.

It is preferred that the foregoing particulate resin be dispersed in the coating resin as uniformly as possible in the vertical direction and in the direction along the tangential line of the surface of the carrier or charge-providing member. At the same time, the matrix resin of the coat layer is preferably uniform. The uniformity of the coat layer allows the capability of providing charge and the capability of preventing the coat layer from being spent to work uniformly and stably through the entire coat layer. Further, since the initial surface composition can be invariably maintained even if the surface of the resin coat layer is worn after prolonged use, the foregoing capabilities can be maintained over an extended period of time.

The foregoing particulate resin can be properly selected from the group consisting of various resins depending on the purpose.

Examples of the thermoplastic resin include polyolefin-based resins such as polyethylene and polypropylene, polyvinyl-based resins or polyvinylidene-based resins such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone, vinyl chloride-vinyl acetate copolymers, styrene-acrylic acid copolymers, straight silicon resins comprising organosiloxane bond or modification products thereof, fluororesins such as polytetrafluoroethylene, polyvinyl fluoride, polyvinylidene fluoride and polychlorotrifluoroethylene, polyesters, and polycarbonates.

Examples of the thermoset resin include phenol resin, urea-formaldehyde resin, melamine resin, benzoguanamine resin, urea resin, amino resin such as polyamide resin, and epoxy resin.

In order to enhance the mechanical strength of carrier and charge-providing member with the particulate resin, a particulate thermoset resin which can enhance hardness relatively easily is preferably used. In particular, a crosslinked particulate resin is preferred. Examples of the process for the preparation of such a crosslinked particulate resin include a process which comprises using polymerization method such as emulsion polymerization and suspension polymerization to prepare a particulate resin, a process which comprises allowing a monomer or oligomer to undergo crosslinking reaction in the form of dispersion in a poor solvent to cause surface tension resulting in granulation, and a process which comprises melt-kneading a low molecular component with a crosslinking agent to cause mixing and reaction, and then crushing the material to a desired particle size by air force or mechanical force.

The average particle diameter of the particulate resin is preferably from 0.1 $\mu$m to 2 $\mu$m. When the average particle diameter of the particulate resin falls below 0.1 $\mu$m, the particulate resin can be very hardly dispersed in the coat layer. On the contrary, when the average particle diameter of the particulate resin exceeds 2 $\mu$m, the particulate resin can easily come off from the coat layer, making it impossible to maintain the original function. The average particle diameter of the particulate resin is more preferably from 0.2 $\mu$m to 1 $\mu$m.

The amount of the particulate resin to be incorporated in the resin coat layer is from 1% to 50% by weight, preferably from 5% to 30% by weight based on the weight of the resin coat layer.

In order to render the toner negatively chargeable, the particulate resin preferably comprises as its constituent nitrogen atom, which has electron donating properties.

The particulate resin is preferably kept particulate even in a solvent. Therefore, the particulate resin is preferably substantially insoluble in a solvent (inert to solvent). In this arrangement, the particulate resin can be kept in the form of primary particle in the resin coat layer without being agglomerated.

In accordance with the present invention, the dispersion of an electrically-conductive particulate material in the resin coat layer makes it possible to raise the electrical conductivity of the resin coat layer of the charge-providing member or carrier. In general, when the carrier or charge-providing member is coated with a resin, it is electrically insulated and thus can hardly work as a developing electrode during development. Accordingly, an edge effect occurs particularly on solid image area, deteriorating solid reproducibility. These problems can be eliminated by the dispersion of an electrically-conductive particulate material in the resin coat layer.

The electrical conductivity of the electrically-conductive particulate material is preferably $10^8$ Ω·cm or less, more preferably $10^5$ Ω·cm or less. The electrically-conductive particulate material can be properly selected from the group consisting of particulate materials having an electrical conductivity falling within the above defined range depending on the kind of the matrix resin, etc. Specific examples of the electrically-conductive particulate material include metal such as gold, silver and copper, carbon black, semiconducting oxide such as titanium oxide and zinc oxide, and titanium oxide, zinc oxide, barium sulfate, aluminum borate or potassium titanate powder coated with tin oxide, carbon black or metal. From the standpoint of stability in production, cost and conductivity, carbon black is preferred. The kind of carbon black is not specifically limited. In practice, however, carbon black having DBP (dibutyl phthalate) oil absorption of from 50 to 300 ml/g which exhibits a good stability in production is preferred. The average particle diameter of the electrically-conductive particulate material is preferably 0.1 $\mu$m or less. For ease of dispersion, carbon black having a primary particle diameter of 50 nm or less is preferred.

The use of a spherical polymer core having a low specific gravity as a particulate nucleus material constituting the carrier of the invention makes it possible to lower the stress on the toner and hence improve the charge maintenance and environmental stability.

Further, the use of the carrier of the invention in combination with a spherically particulate polymer toner produced in a solution makes it possible to obtain a developer which gives an excellent image quality and exhibits an excellent transferability.

In order to form the foregoing resin coat layer on the particulate nucleus material of carrier or the surface of the core material of charge-providing member, a resin coat layer-forming material solution having a matrix resin, a particulate resin, an electrically-conductive particulate material, etc. dissolved or dispersed in a solvent is used. Specific examples of the process for the formation of a resin coat layer include (1) a dipping process involving the dipping of the particulate nucleus material of carrier or the core material of charge-providing member in the foregoing resin coat layer-forming solution, (2) a spray process which comprises spraying a resin coat layer-forming solution onto the particulate nucleus material of carrier or the surface of the core material of charge-providing member, (3) a fluidized bed process which comprises spraying a resin coat layer-forming solution onto the particulate nucleus material of carrier while being suspended in the stream of air, and (4) a kneader-coater process which comprises mixing a particulate nucleus material of carrier and a resin coat layer-forming solution in a kneader-coater, and then removing the solvent. However, the present invention is not limited to these processes using a solution. A powder coating process (5) which comprises mixing with a resin powder under heating may be used depending on the particulate nucleus material of carrier or the core material of charge-providing member to which it is applied.

The solvent to be used for the resin coat layer-forming material solution is not specifically limited so far as it can dissolve a matrix resin therein. Examples of the solvent employable herein include aromatic hydrocarbons such as xylene and toluene, ketones such as acetone and methyl ethyl ketone, ethers such as tetrahydrofuran and dioxane, and halogen compounds such as chloroform and carbon tetrachloride.

The particulate nucleus material to be incorporated in the carrier for the development of an electrostatic latent image of the invention is not specifically limited. Examples of the particulate nucleus material employable herein include magnetic metal such as iron, steel, nickel and cobalt, magnetic oxide such as ferrite and magnetite, and glass bead. The particulate nucleus material is preferably magnetic because the development process requires the use of a magnetic brush. The average particle diameter of the particulate carrier nucleus material is preferably from 10 $\mu$m to 150 $\mu$m, particularly from 20 $\mu$m to 100 $\mu$m. As a particulate ferrite nucleus material there has been preferably used one having a true specific gravity of from 3 to 7 g/cm$^3$ and a saturation magnetization of from 40 to 80 emu/g in recent years.

As the foregoing particulate nucleus material there is preferably used a magnetic powder-dispersed spherical core produced by a polymerization process to lower stress.

The magnetic powder-dispersed spherically particulate material preferably has a true specific gravity of from 3.0 to 4.0 g/cm$^3$ and a saturation magnetization of 50 emu/g or more.

The total applied amount of the coating resin is preferably from 0.3 to 5.0% by weight based on the weight of carrier to accomplish the desired image quality, prevention of secondary hindrance and chargeability at the same time. In the case where the coating resin is applied to the core material of charge-providing member, the applied amount of the coating resin and the coating method are preferably adjusted so as to obtain a proper layer thickness taking into account the chargeability, maintenance, etc. The thickness of the coat layer on the charge-providing member is preferably from 0.1 $\mu$m to 10 $\mu$m.

The carrier for the development of an electrostatic latent image of the invention is mixed with a proper particulate toner to give an electrostatic latent image developer. The toner to be used in the invention is preferably produced by a wet process. The toner to be used in the invention preferably has a shape factor ($ML^2/A$) of 125 or less and a volume-average particle diameter of from 3 $\mu$m to 9 $\mu$m. However, the present invention is not limited to these values. The shape factor can be calculated by the following equation:

$$(ML^2/A)=(\text{average of maximum diameter of projected image of particles})^2/(\text{projected area})\times(100\pi/4)$$

Examples of the process for the production of the toner employable herein include (1) knead crushing process which comprises melt-kneading a binder resin, a colorant, a releasing agent, and optionally a charge controller, etc., crushing the mixture, and then classifying the material thus crushed, (2) process which comprises adjusting the shape of the particles obtained by knead crushing process by mechanical impact or heat energy, (3) emulsion polymerization agglomeration process which comprises mixing a particulate resin dispersion obtained by the emulsion polymerization of polymerizable monomers of binder resin, a colorant, a releasing agent, and optionally a charge controller, etc., allowing the mixture to agglomerate, and then heat-fusing the material to obtain a particulate toner, (4) suspension polymerization process which comprises allowing a solution of polymerizable monomers of binder resin, a colorant, a releasing agent, and optionally a charge controller, etc. to be suspended in an aqueous solvent to cause polymerization, and (5) dissolution suspension process which comprises allowing a solution of a binder resin, a colorant, a releasing agent, and optionally a charge controller, etc. to be suspended in an aqueous solvent to cause granulation. Alternatively, agglomerated particles may be attached to the toner particles thus obtained as core particles. The particles may then be heat-fused to obtain a core-shell toner.

Examples of the toner binder resin employable herein include homopolymers and copolymers such as styrenes (e.g., styrene, chlorostyrene), monoolefins (e.g., ethylene, propylene, butylene, isoprene), vinyl esters (e.g., vinyl acetate, vinyl propionate, vinyl benzoate, vinyl butyrate), $\alpha$-methylenealiphatic monocarboxylic acid esters (e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate), vinylethers (e.g., vinyl methyl ether, vinyl ethyl ether, vinyl butyl ether), and vinylketones (e.g., vinyl methyl ketone, vinyl hexyl ketone, vinyl isopropenyl ketone). Representative examples of the binder resin employable herein include polystyrene, styrene-acrylic acid alkyl copolymer, styrene-methacrylic acid alkyl copolymer, styrene-acrylonitrile copolymer, styrene-butadiene copolymer, styrene-maleic anhydride copolymer, polyethylene, and polypropylene. Further examples of the binder resin employable herein include polyester, polyurethane, epoxy resin, silicone resin, polyamide, modified rosin, and paraffin wax.

Representative examples of the toner colorant employable herein include magnetic powder such as magnetite and ferrite, carbon black, aniline blue, chalcoyl blue, chrome yellow, utramarine blue, Du Pont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Representative examples of the releasing agent employable herein include low molecular polyethylene, low molecular polypropylene, Fisher-Tropsch wax, montan wax, carnauba wax, rice wax, and candelilla wax.

The toner for the development of an electrostatic latent image of the invention may comprise a charge controller incorporated therein as necessary. As such a charge controller there may be used any known material. Examples of the charge controller employable herein include azo-based metal complex compound, metal complex compound of salicylic acid, and resin type charge controller containing polar group.

In the case where the toner is produced by a wet process, materials which can difficultly be dissolved in water are preferably used from the standpoint of control over ionic strength and prevention of pollution with waste water.

As the cleaning aid or transferring aid to be incorporated in the toner there may be used a particulate polystyrene, particulate polymethyl methacrylate, particulate polyvinylidene fluoride or the like. In particular, as the transferring aid there is preferably used a spherically particulate silica having a particle diameter of from 50 nm to 300 nm. The added amount of the transferring aid is from 0.5 to 5 parts by weight, preferably from 1 to 3 parts by weight based on 100 parts by weight of the toner.

Examples of small diameter inorganic compounds to be incorporated in the toner include silica, alumina, titania, calcium carbonate, magnesium carbonate, calcium phosphate, and cerium oxide. If necessary, an inorganic particulate material which has been subjected to surface treatment may be used.

The particulate toner may comprise a magnetic powder incorporated therein besides additives such as charge controller, fluidity improver and fixing aid as necessary.

The toner of the invention may either in the form of magnetic toner containing a magnetic material or in the form of non-magnetic toner free of magnetic material.

In order to mix the toner with external additives, any known mixer such as V-shaped blender, Henschel mixer may be used.

As the image quality is enhanced, the particle diameter of toner decreases. Thus, the average particle diameter of the toner is from 2 $\mu$m to 12 $\mu$m, preferably from 5 $\mu$m to 10 $\mu$m.

The magnetic sleeve for carrying a developer may be made of any known material and may have any known magnetic force. The magnetic sleeve preferably has a surface having a fine roughness such that the ten point average roughness Rz on roughness curve is from 5 $\mu$m to 50 $\mu$m, preferably from 10 $\mu$m to 30 $\mu$m and the arithmetic mean roughness Ra on roughness curve is from 1 $\mu$m to 10 $\mu$m, preferably from 1 $\mu$m to 5 $\mu$m according to JIS B0660 to enhance the stability in conveyance of developer and prevent the scattering of carrier. Such a magnetic sleeve is suitable for carrier having a small diameter and carrier having a small shape factor.

EXAMPLE

The present invention will be further described in the following examples, but the present invention should not be construed as being limited thereto.

The kind of monomers of coating resins, mixing ratio thereof, polymerization method and weight-average molecular weight (Mw) used in the following examples and comparative examples are set forth in Table 1.

TABLE 1

| Coating resin | | Kind of monomer: First component | Mixing ratio | Second component | Mixing ratio | Third component | Mixing ratio | Polymeri-zation process | Weight-average molecular weight (Mw) | Contact angle |
|---|---|---|---|---|---|---|---|---|---|---|
| Example | A | tert-butyl methacrylate | 80% | Perfluorooctyl ethyl methacrylate | 20% | | | Random polymerization | 74,000 | 108° |
| | B | tert-butyl methacrylate | 40% | Methyl methacrylate | 40% | Perfluorooctyl ethyl methacrylate | 20% | Random polymerization | 51,000 | 106° |
| | C | tert-butyl methacrylate | 40% | Methyl methacrylate | 40% | Perfluorooctyl ethyl methacrylate | 20% | Graft polymeri-zation of second component | 56,000 | 109° |
| Comparative Example | D | Methyl methacrylate | 100% | | | | | | 122,000 | 76° |
| | E | Methyl methacrylate | 80% | Perfluorooctyl ethyl methacrylate | 20% | | | Random polymeri-zation | 52,000 | 96° |
| | F | Methyl methacrylate | 70% | Methyl methacrylate | 30% | | | Random polymeri-zation | 80,000 | 78° |

(Preparation of Carrier I)

Particulate Mn-Mg-based ferrite 100 parts by weight
(true specific gravity: 5.0 g/cm3;
shape factor (ML2/A): 120;
average particle diameter: 40 $\mu$m;
saturation magnetization: 65 emu/g)
Toluene 14 parts by weight
Coating resin (A) 1.7 parts by weight
Carbon black (R330R, produced by Cabot 0.12 parts
Specialty Chemicals Inc.; average by weight
particle diameter: 25 nm; DBP value:
71 ml/g; resistivity: $10^2$ Ω·cm or less)
Particulate crosslinked melamine resin 0.3 parts by weight
(average particle diameter: 0.3 $\mu$m;
insoluble in toluene)

The foregoing components, excluding the particulate ferrite, and glass beads (particle diameter: 1 mm; used in the same amount as that of toluene) are charged into a sand mill produced by KANSAI PAINT CO., LTD. The mixture is then stirred at a rotary speed of 1,200 ppm for 30 minutes to prepare a resin coat layer-forming solution. Subsequently, the resin coat layer-forming solution thus prepared and the particulate ferrite are charged into a vacuum deaeration type kneader where they are then kept at a temperature of 60° C. with stirring for 10 minutes. Toluene is then distilled off under reduced pressure to form a resin coat layer. Thus, a carrier is obtained. The average thickness of the coat resin layer is 1.0 μm.

(Preparation of Carrier II)

Particulate Mn-Mg-based ferrite 100 parts by weight
(true specific gravity: 5.0 g/cm3;
shape factor (ML2/A): 120;
average particle diameter: 40 μm;
saturation magnetization: 65 emu/g)
Toluene 14 parts by weight
Coating resin (B) 1.7 parts by weight
Carbon black (R330R, produced by Cabot 0.12 parts
Specialty Chemicals Inc.; average by weight
particle diameter: 25 nm; DBP value:
71 ml/g; resistivity: $10^2$ Ω·cm or less)
Particulate crosslinked melamine resin 0.3 parts by weight
(average particle diameter: 0.3 μm;
insoluble in toluene)

The foregoing components are processed and coated in the same manner as the carrier I to obtain a carrier. The average thickness of the coat resin layer is 0.9 μm.

(Preparation of carrier III)

Particulate Mn-Mg-based ferrite 100 parts by weight
(true specific gravity: 5.0 g/cm3;
shape factor (ML2/A): 116;
average particle diameter: 40 μm;
saturation magnetization: 65 emu/g)
Toluene 14 parts by weight
Coating resin (C) 1.7 parts by weight
Carbon black (R330R, produced by Cabot 0.12 parts
Specialty Chemicals Inc.; average by weight
particle diameter: 25 nm; DBP value:
71 ml/g; resistivity: $10^2$ Ω·cm or less)
Particulate crosslinked melamine resin 0.3 parts by weight
(average particle diameter: 0.3 μm;
insoluble in toluene)

The foregoing components are processed and coated in the same manner as the carrier II to obtain a carrier. The average thickness of the coat resin layer is 0.9 μm.

(Preparation of Carrier IV)

Magnetic powder-dispersed particulate 100 parts by weight
nucleus material (true specific
gravity: 3.7 g/cm3;
shape factor (ML2/A): 105;
average particle diameter: 40 μm;
saturation magnetization:
60 emu/g)
Toluene 14 parts by weight
Coating resin (B) 1.2 parts by weight
Carbon black (R330R, produced by Cabot 0.08 parts
Specialty Chemicals Inc.; average by weight particle diameter: 25 nm; DBP value:
71 ml/g; resistivity: $10^2$ Ω·cm or less)
Particulate crosslinked melamine resin 0.5 parts by weight
(average particle diameter: 0.3 μm;
insoluble in toluene)

The foregoing components are processed and coated in the same manner as the carrier II to obtain a carrier. The average thickness of the coat resin layer is 0.9 μm.

(Preparation of carrier V)

Particulate Mn-Mg-based ferrite 100 parts by (true specific gravity: 5.0 g/cm3; weight
shape factor (ML2/A): 116;
average particle diameter: 40 μm;
saturation magnetization: 65 emu/g)
Coating resin (D) 1.2 parts by weight The foregoing components are processed and coated in the same manner as the carrier II to obtain a carrier. The average thickness of the coat resin layer is 0.8 μm.

(Preparation of Carrier VI)

Particulate Mn-Mg-based ferrite 100 parts by
(true specific gravity: 5.0 g/cm3; weight
shape factor (ML2/A): 116;
average particle diameter: 40 μm;
saturation magnetization: 65 emu/g)
Toluene 14 parts by weight
Coating resin (E) 1.7 parts by weight
Carbon black (R330R, produced by Cabot 0.12 parts
Specialty Chemicals Inc.; average by weight particle diameter: 25 nm; DBP value:
71 ml/g; resistivity: $10^2$ Ω·cm or less)
Particulate crosslinked melamine resin 0.3 parts by (average particle diameter: 0.3 μm; weight
insoluble in toluene)

The foregoing components are processed and coated in the same manner as the carrier II to obtain a carrier. The average thickness of the coat resin layer is 0.9 μm.

(Preparation of Carrier VII)

Particulate Mn-Mg-based ferrite 100 parts by weight (true specific gravity: 5.0 g/cm3;
average particle diameter: 40 μm;
saturation magnetization: 65 emu/g)
Coating resin (F) 1.7 parts by weight The foregoing resin powder and the particulate ferrite are mixed at room temperature for 10 minutes, and then charged into a mixing type kneader where they are then stirred at a temperature of 180° C. for 40 minutes. The mixture is then stirred under cooling for 30 minutes to form a resin coat layer. Thus, a carrier is obtained. The average thickness of the coat resin layer is 0.7 μm.

(Preparation of Toner a)

Linear polyester resin 89 parts by weight (linear polyester prepared from terephthalic acid, bisphenol A-ethylene oxide adduct and cyclohexane dimethanol; Tg=62° C.; Mn=4,000;
Mw=35,000; acid value=12;
hydroxyl number=25)
Polypropylene wax (Mn=3,000) 5 parts by weight
Carbon black (BPL, produced by Cabot 6 parts by weight
Specialty Chemicals Inc.)

The foregoing components are kneaded by an extruder, crushed by a jet mill, and then classified by an air classifier to obtain an amorphous particulate toner having a volume-average particle diameter $d_{50}$Of 6.2 μm and a shape factor ($ML^2/A$) of 137.

(Preparation of Toner b)

Preparation of Particulate Resin Dispersion (1)
Styrene 370 g
n-Butyl acrylate 30 g
Acrylic acid 8 g Dodecane thiol 24 g Carbon tetrabromide 4 g The foregoing components are mixed to obtain a solution. The solution thus obtained is then dispersed and emulsified in a solution of 6 g of a nonionic surface active agent (Nonipole 400, produced by SANYO CHEMICAL INDUSTRIES, LTD.) and 10 g of an anionic surface active agent (Neogen SC, produced by Dai-Ichi Kogyo Seiyaku Co., Ltd.) in 550 g of ion-exchanged water in a flask. To the emulsion thus obtained is then added a solution of 4 g of ammonium persulfate in 50 g of ion-exchanged water with slow stirring to cause nitrogen substitution. The material is then heated over an oil bath with stirring until the temperature of the contents of the flask reached 70° C. Emulsion polymerization lasted for 5 hours to obtain a particulate resin dispersion (1).

The particulate resin constituting the dispersion (1) had an average particle diameter of 155 nm, Tg of 59° C. and a weight-average molecular weight Mw of 12,000.

(Preparation of Particulate Resin Dispersion (2))

Styrene 280 g n-Butyl acrylate 120 g

Acrylic acid 8 g

The foregoing components are then processed in the same manner as the particulate resin dispersion (1) to obtain a particulate resin dispersion (2).

The particulate resin constituting the dispersion (2) had an average particle diameter of 105 nm, Tg of 53° C. and a weight-average molecular weight Mw of 550,000.

(Preparation of Colorant Dispersion (1))

Carbon black (Mogal L, produced by 50 g

Cabot Specialty Chemicals Inc.)

Nonionic surface active agent 5 g (Nonipole 400, produced by SANYO CHEMICAL

INDUSTRIES, LTD.)

Ion-exchanged water 200 g

The foregoing components are mixed to obtain a solution. The solution is then subjected to dispersion by a homogenizer (Ultralatax T50, produced by IKA Inc.) for 10 minutes to prepare a colorant dispersion (1) having a colorant (carbon black) having an average particle diameter of 250 nm dispersed therein.

(Preparation of Releasing Agent Dispersion (1))

Paraffin wax 50 g (HNP0190, produced by Nippon Seiro Co.,

Ltd.; m.p.: 85° C.)

Cationic surface active agent 5 g (Sanisol B50, produced by Kao corp.)

Ion-exchanged water 200 g

The foregoing components are heated to a temperature of 95° C., dispersed by a homogenizer (Ultralatax T50, produced by IKA Inc.), and then subjected to dispersion by a pressure-discharging homogenizer to prepare a releasing agent dispersion (1) having a releasing agent having an average particle diameter of 550 nm dispersed therein.

(Preparation of Agglomerated Particles)

Particulate resin dispersion (1) 120 g

Particulate resin dispersion (2) 80 g

Colorant dispersion (1) 30 g

Releasing agent dispersion (1) 40 g

Cationic surface active agent 1.5 g (Sanisol B50, produced by Kao Corp.)

The foregoing components are mixed in a round stainless steel flask by a homogenizer (Ultratalax T50, produced by IKA Inc.) to obtain a dispersion. The dispersion is then heated to a temperature of 50° C. with stirring in the flask over a heating oil bath. The dispersion is then kept at a temperature of 45° C. to obtain a dispersion of agglomerated particles. When observed under optical microscope, the dispersion is confirmed to have agglomerated particles having an average particle diameter of about 5.0 μm formed therein.

(Preparation of Coated Particles)

To the dispersion of agglomerated particles is added slowly 60 g of the particulate resin dispersion (1). The temperature of the heating oil bath is raised to 50° C. where the mixture is then kept for 40 minutes to obtain a dispersion of coated particles. When observed under optical microscope, the dispersion is confirmed to have coated particles having an average particle diameter of about 5.8 μm formed therein.

To the foregoing dispersion of coated particles is then added 3 g of an anionic surface active agent (Neogen SC, produced by Dai-Ichi Kogyo Seiyaku Co., Ltd.). The foregoing stainless steel flask is sealed with a magnetic seal. The material is heated to a temperature of 105° C. with continued stirring. The dispersion is kept at this temperature for 4 hours to cause fusion. Thereafter, the reaction product is cooled, filtered, thoroughly washed with ion-exchanged water, and then dried to obtain a toner b for the development of an electrostatic latent image. The toner b had a volume-average particle diameter $d_{50}$ of 6.0 μm and a shape factor ($ML^2/A$) of 106.

(External Additive (1))

An external additive (1) is obtained by treating an acicular rutile titanium dioxide with decylsilane. (volume-average particle diameter $d_{50}$: 15 nm; powder resistivity: $10^{15}$ Ω·cm)

(External Additive (2))

Silica sol obtained by sol-gel method is treated with hexamethyl disilazalane, dried, and then crushed to obtain a spherically particulate monodisperse silica. (Shape factor ($ML^2/A$): 105; volume-average particle diameter $d_{50}$: 135 nm)

(Preparation of Developer)

The foregoing carriers I to VII, toners a and b, and external additives (1) and (2) are comparatively evaluated for properties as combined set forth in Table 2.

Toners for the development of an electrostatic latent image of Examples 1 to 5 and Comparative Examples 1 to 3 are obtained by blending a mixture of 100 parts by weight of the toner with 1 part by weight of the external additive (1) by a Henschel mixer at a peripheral speed of 30 m/s for 10 minutes, and then removing coarse particles through a sieve having a mesh size of 45 μm.

Toners for the development of an electrostatic latent image of Example 6 and Comparative Example 4 are obtained by blending a mixture of 100 parts by weight of the toner with 1 part by weight of the external additive (1) and the external additive (2) by a Henschel mixer at a peripheral speed of 30 m/s for 10 minutes, and then removing coarse particles through a sieve having a mesh size of 45 μm.

7 parts by weight of the toner for the development of an electrostatic latent image thus obtained and 100 parts by weight of the various carriers are combined as set forth in Table 2, stirred at a rotary speed of 40 rpm by a V blender for 20 minutes, and then sieved through a sieve having a mesh size of 177 μm to obtain an electrostatic latent image developer.

For the evaluation of the properties of these electrostatic latent image developers, a development system comprising a magnetic sleeve the surface of which has a fine roughness such that Rz is 20 μm and Ra is 3 μm is used except for Comparative Example 4. For the evaluation of the properties of Comparative Example 4, a magnetic sleeve free of roughness such that Rz is smaller than 2 μm and Ra is smaller than 1 μm is used.

TABLE 2

| Example No. | Carrier (resin) | Toner | External additive | Properties to be evaluated | Contents of evaluation |
|---|---|---|---|---|---|
| Ex. 1 | 1 (A) | a | (1) | Effect of coating resin | Environmental difference in chargeability<br>Maintenance of chargeability<br>Maintenance of image quality<br>Efficiency of transferring<br>Evaluation of image quality |
| Ex. 2 | II (B) | a | (1) | Effect of coating resin | Environmental difference in chargeability<br>Maintenance of chargeability<br>Maintenance of image quality |
| Ex. 3 | III (C) | a | (1) | Effect of coating resin | Environmental difference in chargeability<br>Maintenance of chargeability<br>Maintenance of image quality |
| Ex. 4 | IV (B) | a | (1) | Effect of particulate nucleus material | Environmental difference in chargeability<br>Maintenance of chargeability<br>Maintenance of image quality |
| Comparative Ex. 1 | V (D) | a | (1) | Effect of coating resin | Environmental difference in chargeability |
| Comparative Ex. 2 | VII (F) | a | (1) | Effect of coating resin | Environmental difference in chargeability |
| Comparative Ex. 3 | VI (E) | a | (1) | Effect of coating resin | Environmental difference in chargeability<br>Maintenance of chargeability<br>Maintenance of image quality |
| Ex. 5 | II (B) | b | (1) | Toner effect | Efficiency of transferring<br>Evaluation of image quality |
| Ex. 6 | II (B) | b | (1) + (2) | Toner effect<br>Effect of external additive<br>Effect of sleeve | Efficiency of transferring<br>Evaluation of image quality<br>Stability in conveyance |
| Comparative Ex. 4 | II (B) | b | (1) + (2) | Effect of sleeve | Stability in conveyance<br>Evaluation of image quality |

Evaluation Method

These developers are comparatively evaluated using an electrophotographic copying machine (remodeled version of A-color 936, produced by Fuji Xerox Co., Ltd.).

(1) Environmental Difference in Chargeability

[Examples 1 to 4; Comparative Examples 1 to 3]

The developers of Examples 1 to 4 and Comparative Examples 1 to 3 are charged into the developing machine of the foregoing electrophotographic copying machine, and then allowed to stand under high temperature and humidity conditions (28° C., 80%RH) and low temperature and humidity conditions (10° C., 15%RH) overnight. The electrophotographic copying machine is then allowed to run idle under the respective conditions for 30 minutes. The developers are each evaluated for chargeability. The results are set forth in Table 3 below.

For the measurement of charged amount, a blow-off method is employed.

The evaluation of chargeability is effected in accordance with the following criterion.

⊙: Very good; ○: Good; x: Poor; xx: Very poor

TABLE 3

| Developer | Charged amount (μC/g) High temp.-high humidity | Low temp.-low humidity | High temp.-high humidity/low temp.-low humidity | Judgment |
|---|---|---|---|---|
| Example 1 | −31.2 | −34.3 | 0.91 | ⊙ |
| Example 2 | −30.8 | −32.4 | 0.95 | ⊙ |
| Example 3 | −33.1 | −34.5 | 0.96 | ⊙ |
| Example 4 | −28.7 | −31.2 | 0.92 | ⊙ |
| Comparative Example 1 | −20.4 | −63.8 | 0.31 | xx |
| Comparative Example 2 | −29.8 | −46.8 | 0.64 | x |
| Comparative Example 3 | −19.5 | −47.5 | 0.41 | x |

[Criterion: ⊙: Very good; x: Poor; xx: Very poor]

(2) Maintenance of Chargeability/maintenance of Image Quality

[Examples 1 to 4; Comparative Example 3]

The developers of Examples 1 to 4 and Comparative Example 3 are each charged into the developing machine of the foregoing electrophotographic copying machine, and then allowed to stand under high temperature and high humidity conditions (28° C., 80%RH) and low temperature and low humidity conditions (10° C., 15%RH) overnight. Images are then duplicated on 50,000 sheets under the respective conditions with the foregoing developing machine attached to the foregoing copying machine at the black toner position thereof. The 1st sheet, 1,000th sheet and 50,000th sheet are then evaluated for image quality and chargeability. The results are set forth in Table 4.

◎: Very good;○: Good; Δ: slightly poor; x: Poor

TABLE 4

| Example No. | Charged amount under high temp. -high humidity conditions (μC/g) Initial | 1,000th sheet | 50,000th sheet | Charged amount under low temp. -low humidity conditions (μC/g) Initial | 1,000th sheet | 50,000th sheet | Judgment |
|---|---|---|---|---|---|---|---|
| Example 1 | −32.8 ◎ | −31.5 ◎ | −29.2 ○ | −35.4 ◎ | −34.6 ◎ | −33.5 ◎ | ◎ |
| Example 2 | −33.6 ◎ | −32.0 ◎ | −29.8 ○ | −33.0 ◎ | −32.8 ◎ | −31.0 ◎ | ◎ |
| Example 3 | −32.8 ◎ | −33.0 ◎ | −29.0 ○ | −34.6 ◎ | −35.1 ◎ | −32.8 ◎ | ◎ |
| Example 4 | −29.2 ◎ | −32.0 ◎ | −28.5 ◎ | −32.6 ◎ | −34.2 ◎ | −31.0 ◎ | ◎ |
| Comparative Example 3 | −20.1 Δ | −18.5 Fog x | −17.0 Fog x | −48.0 Δ | −52.5 Low density x | −43.2 Δ | x |

[Upper case: charged amount; lower case: evaluation of image quality; ◎: Very good; ○: Good; Δ: slightly poor; x: Poor]

(3) Evaluation of Efficiency of Transferring/image Quality [Examples 1, 5, 6]

The developers of Examples 1, 5 and 6 are each charged into the foregoing developing machine, and then evaluated for efficiency of transferring and image quality under middle temperature and middle humidity conditions (20° C., 40% RH).

For the evaluation of efficiency of transferring, the amount of toner which had been transferred to the transferring belt per unit area (TMA) and the amount of toner which had been left on the photoreceptor per unit area (DMA) are measured. By substituting the measurements in the following equation, efficiency of transferring can be calculated.

$$\text{Efficiency of transferring}=(\text{TMA})/(\text{TMA}+\text{DMA})$$

For the evaluation of image quality, several photographs and letters are sampled and observed through5 x magnifier. The results are set forth in Table 5.

◎: Very good image quality upon transferring; ○: Good; Δ: slightly poor; x: Poor

TABLE 5

| Example No. | Efficiency of transferring | Evaluation of image quality: Graininess | Reproducibility of fine line | Edge effect |
|---|---|---|---|---|
| Example 1 | 88.6% | ○ | ○ | ◎ |
| Example 5 | 95.6% | ○ | ◎ | ◎ |
| Example 6 | 98.8% | ◎ | ◎ | ◎ |

(4) Stability in Conveyance

[Example 6; Comparative Example 4]

The developer of Example 6 is evaluated for stability in conveyance with the foregoing sleeve having a roughened surface or sleeve free of roughness attached to the developing machine. The case where the sleeve free of roughness is used is designated as Comparative Example 4. For the evaluation of stability in conveyance, the difference in the amount of developer per unit area between above and down the outlet at the regulating plate is determined.

The criterion of image quality is as follows.

: Very good image quality; ○: Good; Δ: slightly poor; x: Poor]

TABLE 6

| Example No. | Sleeve Rz | Amount of developer per unit area (g/m³) Up-stream | Down-stream | Evaluation of image quality | Judgment |
|---|---|---|---|---|---|
| Example 6 | 20 | 511 | 524 | ◎ | ◎ |
| Comparative Example 4 | <2 | 324 | 825 | x: carrier scattered | x |

[Criterion of image quality: ◎: Very good; ○: Good; Δ: slightly poor; x: Poor]

In accordance with the present invention, the use of the foregoing constitution makes it possible to give a capability of rendering the charge-providing member and the toner of carrier for the development of an electrostatic latent image properly and stably chargeable, exhibit a stable chargeability even in varying environments and maintain these properties over an extended period of time. Further, the charge-providing member and the carrier for the development of an electrostatic latent image of the present invention is arranged such that they can be prevented from being spent by the toner over an extended period of time. In this arrangement, an electrophotographic image having a fairly reproduced half tone and a good image quality can be provided over an extended period of time.

What is claimed is:

1. A carrier for the development of an electrostatic latent image comprising a resin coat layer provided on a core material, wherein said resin coat layer comprises a (meth)acrylic acid alkyl ester copolymer containing as copolymerizing components a (meth)acrylic acid alkyl ester containing a branched alkyl group having 4 or more carbon atoms and a (meth)acrylic acid alkyl ester containing a fluorine-containing alkyl group.

2. The carrier for the development of an electrostatic latent image according to claim 1, wherein said resin coat layer exhibits a contact angle of from 80 to 150 degrees with respect to water.

3. The carrier for the development of an electrostatic latent image according to claim 1, wherein said core material is a magnetic particulate material.

4. The carrier for the development of an electrostatic latent image according to claim 3, wherein said resin coat layer exhibits a contact angle of from 80 to 150 degrees with respect to water.

5. The carrier for the development of an electrostatic latent image according to claim 3, wherein said magnetic particulate material has an average particle diameter of from 20 μm to 100 μm.

6. The carrier for the development of an electrostatic latent image according to claim 3, wherein as the copolymerizing component of said (meth)acrylic acid alkyl ester there is incorporated a $C_{1-5}$ straight-chain alkyl group.

7. The carrier for the development of an electrostatic latent image according to claim 3, wherein said copolymer has a graft copolymer structure.

8. The carrier for the development of an electrostatic latent image according to claim 3, wherein said resin coat layer has a weight-average molecular weight (Mw) of from 5,000 to 250,000.

9. The carrier for the development of an electrostatic latent image according to claim 3, wherein said resin coat layer has one or more particulate resins dispersed therein.

10. The carrier for the development of an electrostatic latent image according to claim 3, wherein said resin coat layer comprises a finely divided electrically-conductive material dispersed therein.

11. The carrier for the development of an electrostatic latent image according to claim 3, wherein a particulate nucleus body comprises a magnetic powder-dispersed spherical core material having a shape factor ($ML^2/A$) of 125 or less, a true specific gravity of from 3 to 4 g/cm$^3$ and a saturation magnetization of 50 emu/g or more.

12. An electrostatic latent image developer comprising a toner and a carrier, wherein the core material is a magnetic particulate material; and said toner has a shape factor ($ML^2/A$) of 125 or less and the carrier comprises the carrier according to claim 3.

13. The electrostatic latent image developer according to claim 12, wherein said toner is prepared by a wet process.

14. The electrostatic latent image developer according to claim 12, wherein said toner has a spherically particulate silica having a cumulative volume-average particle diameter $D_{50V}$ of from 80 to 300 nm externally added to the surface thereof.

15. A process for the formation of an image comprising the steps of forming a latent image on a latent image holding member, developing said latent image with a developer provided on a sleeve, and transferring the developed toner image onto a transferring material, wherein said sleeve to be used in said developing step has a surface having a fine roughness such that the ten point average roughness Rz on roughness curve is from 10 $\mu$m to 30 $\mu$m and the arithmetic mean roughness Ra on roughness curve is from 1 $\mu$m to 5 $\mu$m according to JIS B0660 and said developer to be used in said developing step is a developer according to claim 13.

16. The process for the formation of an image according to claim 15, wherein said toner has a spherically particulate silica having a cumulative volume-average particle diameter $D_{50V}$ of from 80 to 300 nm externally added to the surface thereof.

17. The carrier for the development of an electrostatic latent image according to claim 1, which is a one-component developing sleeve.

* * * * *